United States Patent [19]

White

[11] 3,957,932

[45] May 18, 1976

[54] HUMIDIFIER

[75] Inventor: Robert L. White, St. Charles, Mo.

[73] Assignee: American Air Filter Company, Inc., Louisville, Ky.

[22] Filed: Nov. 26, 1974

[21] Appl. No.: 527,503

[52] U.S. Cl. ..... 261/142; 98/109; 219/275; 219/362; 261/DIG. 15

[51] Int. Cl.[2] ..... F24F 3/14; H05B 3/00

[58] Field of Search ..... 261/142, DIG. 15; 126/20, 113; 219/362, 271, 273, 275; 98/30, 109

[56] References Cited

UNITED STATES PATENTS

| | | | |
|---|---|---|---|
| 2,230,245 | 2/1941 | Hettinger | 219/275 |
| 3,219,795 | 11/1965 | Wiseman | 261/142 |
| 3,378,238 | 5/1968 | Babington et al. | 261/DIG. 15 |
| 3,873,806 | 3/1975 | Schossow | 261/142 |

*Primary Examiner*—Tim R. Miles
*Assistant Examiner*—Gregory N. Clements

[57] ABSTRACT

Humidifier for humidifying air utilizing a shallow pan of high surface area with a plurality of wells of relatively deep, but small cross-sectional area therein with heating elements disposed within said wells whereby upon heating liquid in the wells, heat is transferred rapidly to the remaining liquid in the shallow pan, the liquid being brought to vaporizing temperature quite rapidly.

5 Claims, 1 Drawing Figure

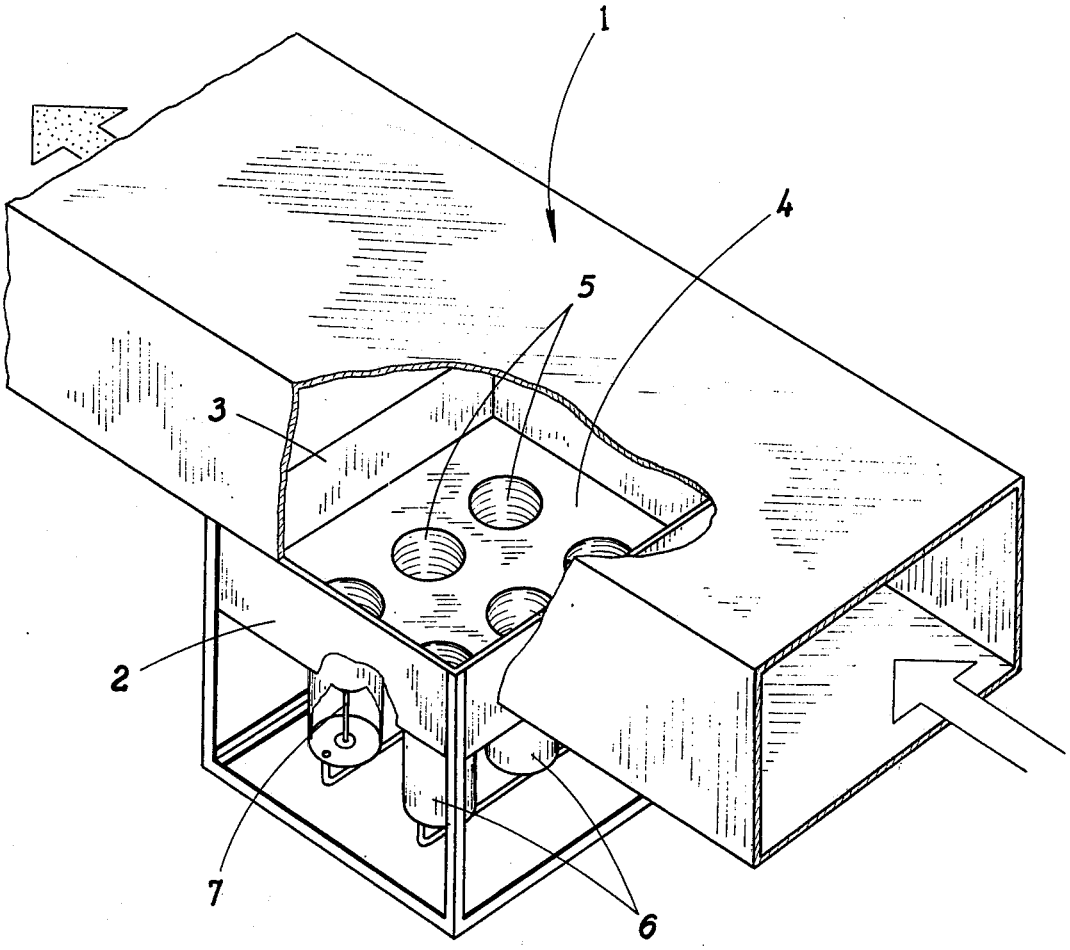
1
4
5
3
2
7
6

HUMIDIFIER

BACKGROUND OF THE INVENTION

This invention relates to humidifiers and more particularly relates to a novel humidifier construction for admitting moisture into the air in an enclosed area.

In forced air heating systems, the forced air heaters heating up the air in an enclosed structure, such as a commercial building, house, or the like greatly reduce the relative humidity in the structure. The reduction or constant varying of the humidity in the atmosphere in these structures has been found to create an unhealthy environment. Also, varying humidity levels have been found to dry and crack articles, such as furniture, wall hangings, and the like which are disposed within the confines of the structure. Thus, the maintenance of proper moisture content in the enclosed areas is particularly important.

In order to maintain a proper humidity level within selected enclosed areas, many different types of humidifiers have been devised and are presently available today on commercial markets. The most common types of humidifiers available today include firstly, the plate type, which includes a shallow open tank with a plurality of filter plates mounted therein extending vertically therefrom wherein the tank is partially filled with water to immerse bottom portions of the plate and the water is drawn upwardly through the plates and dry hot air is directed over the plates to transfer the moisture from the pan to the airstream passing thereover. A second type of humidifier presently commercially available is of the rotary wheel type wherein a drum or wheel of filter material is mounted within a tank or housing which is partially filled with water to cover the lower portion of the drum. The drum or wheel then rotates through the water in the tank or housing and into an airstream which is directed over the upper portion of the drum thereby transferring moisture to the airstream. A third type of humidifier presently commercially available is the spray type humidifier which generally consists of a nozzle connected to a water spray for producing a fine mist spray which is directed into a hot airstream in a forced air heating system. In the aforementioned, water added to the hot airstream is vaporized by the heat of the relatively dry air as the temperature of the water in the humidifier is below the temperature of the dry airstream. Thus, the temperature of the dry airstream passing over the humidifier is decreased by an amount equivalent to the amount of energy necessary to vaporize the moisture in which the airstream is coming in contact.

SUMMARY OF THE INVENTION

The present invention provides a humidifier to solve the problem of adding cool, wet moisture to a hot, dry airstream which results in a humidifier whic is economical to manufacture and easy to install. The present invention further provides a humidifier which includes heat means therein to bring the body of water in the humidifier to a temperature sufficient to vaporize the moisture without depending upon heat energy from the dry airstream for such vaporization. The present invention even further provides a humidifier which is capable of heating a body of water to a vaporizing temperature in a relatively short period of time.

According to the present invention, a humidifying device utilizing a shallow pan of high surface area with a plurality of wells of relatively deep, but small cross-sectional area with heat means disposed therein is provided whereby liquid disposed within the pan and the accompanying wells is brought to a vaporizing temperature very rapidly and transferred to a hot airstream passing thereover.

More particularly, the present invention provides a humidifying device comprising an elongated pan with a bottom and a plurality of relatively short side walls, the bottom having a plurality of openings therein, each opening being in communication with an elongated chamber, the chamber having the same cross-sectional areas as the opening and being in axial alignment therewith; and, each chamber having disposed therein elongated heating elements.

It is to be understood that the description of the examples of the present invention given hereinafter are not by way of limitation. Various modifications within the scope of the present invention will occur to those skilled in the art upon reading the disclosure set forth hereinafter.

REFERRING TO THE DRAWING

The FIGURE is a perspective view, with selected portions cut-away, of a humidifying device of the present invention.

The FIGURE illustrates one humidifying device of the present invention disposed within an air duct 1. The humidifying device includes a shallow pan 2 with four vertically extending side members 3. Vertically extending side members 3 are of relatively short height whereby the ratio of surface area to volume of liquid in the pan is maintained relatively large. The bottom of the pan 4 includes a plurality of openings 5 therein which are in communication with elongated cylindrical chambers or cylinders 6. Cylinders 6 are of relatively small cross-sectional area in relation to their volume. The cylinders 6 are of substantially the same cross-sectional area as the opeings 5 in the pan and are axially aligned with the openings 5. Disposed within the cylinders 6 are elongated heating elements 7 which extend upwardly from the bottom of the closed end of the cylinders. The length of the heating elements 7 are generally at least two-thirds of the length of the cylinder 6 so that upon application of heat to the cylinder, the water disposed within the individual cylinders are heated rapidly. Thus, the water in the shallow pan 2 is also heated and brought to a vaporization temperature quite rapidly.

In one preferred example, the pan 2 is of 18 gauge stainless steel having dimensions of 2 feet by 1.3 feet with sides 3 being of 4 inches in height. Six openings 5 are disposed therein, the openings 5 having a diameter of 4 inches each. Cylinders 6 which are in communication with the openings 5 are 10 inches in length and the heating elements 7 which are disposed within the cylinders 6 are 7.75 inches in length and operate at a power of 2000 watts. The ratio of the cross-sectional area to volume of the pan to the cross-sectional area to volume of the cylinders is about 3.35 to 1. Upon the addition of 8 gallons of water to this unit at 70°F, it has been found that upon applying heat to the heating element 7, within a period of 20 minutes there is added to a hot airstream passing over the pan 32 pounds per hour of vaporized moisture.

It is realized that various changes may be made to the specific embodiment shown and described without departing from the principals and spirit of the present invention.

What is claimed is:

1. A humidifying device comprising an elongated pan with a bottom and a plurality of relatively short sides, said bottom having a plurality of openings therein, each opening being in communication with upwardly extending side walls of an elongated chamber, said side walls being longer than said short sides of said pan, said chamber having the same cross-sectional area as said opening; and, each chamber having disposed therein an elongated heating element.

2. The humidifying device of Claim 1 wherein said elongated heating elements are at least two-thirds of the length of each chamber.

3. The humidifying device of claim 1 wherein said elongated heating elements are in axial alignment with said openings.

4. The humidifying device of claim 1 wherein the ratio of the cross-sectional area to volume of the pan to the cross-sectional area to volume of the chamber is at least 3.35 to 1.

5. The humidifying device of claim 1 wherein the elongated pan is disposed within an air duct whereby air flows across the top of the pan entraining the vapor evaporating from said pan.

* * * * *